US007235337B2

(12) United States Patent
Kameyama et al.

(10) Patent No.: US 7,235,337 B2
(45) Date of Patent: Jun. 26, 2007

(54) TONER FOR ELECTROSTATIC IMAGE DEVELOPMENT

(75) Inventors: Koji Kameyama, Wakayama (JP); Nobumichi Kamiyoshi, Wakayama (JP); Kouhei Katayama, Wakayama (JP); Hiroyuki Kawaji, Wakayama (JP); Masahito Yamazaki, Wakayama (JP)

(73) Assignee: Kao Corporation, Tokyo (JP)

( * ) Notice: Subject to any disclaimer, the term of this patent is extended or adjusted under 35 U.S.C. 154(b) by 374 days.

(21) Appl. No.: 10/879,738

(22) Filed: Jun. 30, 2004

(65) Prior Publication Data

US 2005/0003290 A1 Jan. 6, 2005

(30) Foreign Application Priority Data

Jul. 2, 2003 (JP) ..... 2003-270366

(51) Int. Cl.
*G03G 9/087* (2006.01)

(52) U.S. Cl. ..... 430/108.23; 430/109.4; 430/108.4

(58) Field of Classification Search ..... 430/108.4, 430/109.4, 108.23
See application file for complete search history.

(56) References Cited

U.S. PATENT DOCUMENTS 4,401,741 A * 8/1983 Miyakawa et al. .... 430/108.23
2002/0098434 A1* 7/2002 Anno et al. ..... 430/109.4
2003/0073017 A1 4/2003 Fields et al.
2006/0078815 A1* 4/2006 Ito et al. ..... 430/109.4

FOREIGN PATENT DOCUMENTS

JP 3-63065 9/1991
JP 06161155 A * 6/1994
WO WO-2004/057419 A2 * 8/2004

OTHER PUBLICATIONS

Patent Abstracts of Japan, JP 10-221879, Aug. 21, 1998.
Patent Abstracts of Japan, JP 2003-015365, Jan. 17, 2003, (with corr. US 2003/0073017 A1).
Patent Abstracts of Japan, JP 02-264970, Oct. 29, 1990.

* cited by examiner

*Primary Examiner*—Christopher Rodee
(74) *Attorney, Agent, or Firm*—Oblon, Spivak, McClelland, Maier & Neustadt, P.C.

(57) ABSTRACT

A toner for electrostatic image development, containing a resin binder containing a polyester having monomer units wherein at least one monomer is selected from the group consisting of fumaric acid and maleic acid, including mixtures thereof; a colorant; and a charge control agent containing a negatively chargeable charge control agent and a positively chargeable charge control agent, wherein the unreacted monomers of fumaric acid, maleic acid or both fumaric acid and maleic acid are contained in the toner in an amount of 0.20% by weight or less. The toner for electrostatic image development of the present invention may be used for the development of a latent image formed in electrophotography, electrostatic recording method, electrostatic printing method or the like.

15 Claims, No Drawings

TONER FOR ELECTROSTATIC IMAGE DEVELOPMENT

FIELD OF THE INVENTION

The present invention relates to a toner for electrostatic image development, which is used, for instance, for the development of a latent image formed in electrophotography, electrostatic recording method, electrostatic printing method or the like.

BACKGROUND OF THE INVENTION

In recent years, with the trends of higher speeds and higher image quality in the field of electrophotography, durability, triboelectric stability and fixing ability have been earnestly desired for the toners. In view of these technical problems, polyesters have been widely used because of their high durability and excellent colorant dispersion. However, the triboelectric properties such as triboelectric charges and triboelectric stability are still unsatisfactory, so that further improvements have been desired. Therefore, in order to improve the triboelectric properties of toners containing a polyester as a resin binder, there have been reported toners containing several kinds of charge control agents.

For instance, for the purpose of improving triboelectric stability during durability printing, there has been proposed a developer which contains a polyester, a colorant, a positively chargeable charge control agent and a negatively chargeable charge control agent, wherein the developer has a specified average particle size distribution (see Japanese Patent Laid-Open No. Hei 10-221879). Also, there has been proposed a developer composition for electrophotography, which contains a specified polyester, a positively chargeable charge control agent and a negatively chargeable charge control agent, wherein the amount of the positively chargeable charge control agent used is half, or less, than the amount of the negatively chargeable charge control agent used (Japanese Examined Patent Publication No. Hei 3-63065).

In addition, for the purpose of improving triboelectric charges to thereby reduce toner dropping, there has been proposed a toner which contains a first charge control agent and a second charge control agent, wherein a dicarboxylic acid such as fumaric acid are positively added as the first charge control agent (see Japanese Patent Laid-Open No. 2003-15365).

However, the toners mentioned above have a disadvantage that the toners cannot maintain stable triboelectric charges because they are influenced by their environmental factors such as humidity, temperature and the like. Therefore, in order to improve the environmental stability of triboelectric charges, there has been proposed a technique of using a quaternary ammonium salt as a charge control agent, for instance, a negatively chargeable toner which contains a polyester, a positively chargeable charge control agent and a negatively chargeable charge control agent, wherein a quaternary ammonium salt is contained as the positively chargeable charge control agent (see Japanese Patent Laid-Open No. Hei 2-264970).

SUMMARY OF THE INVENTION

The present invention relates to a toner for electrostatic image development, containing:

a resin binder containing a polyester having monomer units wherein at least one monomer is selected from the group consisting of fumaric acid, maleic acid, and mixtures thereof;

a colorant; and a charge control agent containing a negatively chargeable charge control agent and a positively chargeable charge control agent, wherein unreacted monomers of fumaric acid, maleic acid or both fumaric acid and maleic acid are contained in the toner in an amount of 0.20% by weight or less.

DETAILED DESCRIPTION OF THE INVENTION

Polyesters obtainable from fumaric acid, maleic acid or both as a raw material monomer and containing a lower amount of a lower-molecular weight component content are preferable as a resin binder from the viewpoint of deterioration of image qualities due to transfer failure caused by embedment of silica into the toner during continuous printing. However, the environmental stability of the triboelectric charges has not been satisfactory.

The present invention relates to a toner for electrostatic image development, which has for example an excellent triboelectric stability against environmental changes, and is capable of stably providing excellent fixed images for a long period of time.

These and other advantages of the present invention will be apparent from the following description.

The preferred toner for electrostatic image development of the present invention exhibits excellent effects of having an excellent triboelectric stability against environmental changes, and being capable of stably providing excellent fixed images for a long period of time.

One of the significant features of the present invention resides in that a toner for electrostatic image development contains a resin binder containing a polyester having monomer units wherein at least one monomer is selected from the group consisting of fumaric acid, maleic acid, and mixtures thereof; a colorant; and a charge control agent containing a negatively chargeable charge control agent and a positively chargeable charge control agent, wherein the unreacted monomers of fumaric acid, maleic acid or both fumaric acid and maleic acid are contained in the toner in a specified amount or less. The polyester is obtainable from raw material monomers with at least one monomer selected from the group consisting of fumaric acid, maleic acid or both fumaric acid and maleic acid. By having this feature, in the toner of the preferred embodiment of the present invention, an external additive such as silica is less likely to be embedded in the toner surface, the durability is excellent, and the triboelectric stability against environmental changes is markedly improved.

The polyester containing fumaric acid, maleic acid or both fumaric acid and maleic acid as monomer units or raw material monomers preferably contains a lower amount of low-molecular components derived from the alcohol component in the resin, as compared to those containing the other dicarboxylic acids. Therefore, the preferred toner has an effect that an external additive such as silica is less likely to be embedded in the toner when a high shearing force (external force) is applied by a development roller member or the like.

The fumaric acid and the maleic acid in the toner may remain in the toner as unreacted monomers during the preparation of polyester. Unreacted monomers of fumaric acid, maleic acid or both fumaric acid and maleic acid are contained in the toner in an amount of 0.20% by weight or less, preferably from 0.01 to 0.15% by weight, more preferably from 0.01 to 0.1% by weight. The environmental stability tends to be improved by reducing the amount of unreacted monomers of fumaric acid, maleic acid or both. To reduce such amount of fumaric acid, maleic acid or both, the starting amounts of the carboxylic acid component and the alcohol component or the reaction time may be appropriately adjusted, or an esterification catalyst may be added at a terminal stage of the reaction. For instance, there is included a method of adjusting the starting molar ratio of the total hydroxyl groups in the alcohol component to the total carboxylic groups in the carboxylic acid component to greater than 1, a method of extending reaction time, and the like. The amount of unreacted monomers of fumaric acid, maleic or both fumaric acid and maleic acid in the toner is measured according to the method described in Examples.

The polyester is contained in an amount of preferably from 50 to 100% by weight, more preferably from 80 to 100% by weight, even more preferably 100% by weight, of the resin binder. The resin binder other than the polyester includes styrene-acrylic resins, epoxy resins, polycarbonates, polyurethanes, hybrid resins in which two or more resin components are partially chemically bonded to each other, and the like.

The polyester may be obtained in the same manner as in usual polyesters by polycondensation of raw material monomers containing a known dihydric or higher polyhydric alcohol as the alcohol component and a known dicarboxylic or higher polycarboxylic acid compound as the carboxylic acid component, except that fumaric acid, maleic acid or both are used as the dicarboxylic acid compound. Here, fumaric acid, maleic acid or both fumaric acid and maleic acid is contained in an amount of preferably from 1 to 100% by mol, more preferably from 20 to 100% by mol, even more preferably from 40 to 100% by mol, even more preferably from 50 to 100% by mol, even more preferably from 55 to 100% by mol, of the entire carboxylic acid component, from the viewpoint of reducing the low-molecular components derived from the alcohol component in the resin.

The dicarboxylic acid other than fumaric acid and maleic acid includes dicarboxylic acids such as phthalic acid, isophthalic acid and terephthalic acid; a substituted succinic acid of which substituent is an alkyl group having 1 to 20 carbon atoms or an alkenyl group having 2 to 20 carbon atoms; anhydrides of these acids; alkyl (1 to 12 carbon atoms) esters of these acids; and the like.

The tricarboxylic or higher polycarboxylic acid compound includes 1,2,4-benzenetricarboxylic acid (trimellitic acid), acid anhydrides thereof, alkyl (1 to 12 carbon atoms) esters thereof, and the like.

The dihydric alcohol includes an alkylene (2 or 3 carbon atoms) oxide (average number of moles: 1 to 10) adduct of bisphenol A, such as polyoxypropylene(2.2)-2,2-bis(4-hydroxyphenyl)propane and polyoxyethylene(2.0)-2,2-bis(4-hydroxyphenyl)propane, ethylene glycol, propylene glycol, 1,6-hexanediol, bisphenol A, hydrogenated bisphenol A, and the like.

The trihydric or higher polyhydric alcohol includes sorbitol, 1,4-sorbitan, pentaerythritol, glycerol, trimethylolpropane, and the like.

Incidentally, the content of trivalent or higher polyvalent monomers, specifically, the total content of the trihydric or higher polyhydric alcohols and the tricarboxylic or higher polycarboxylic acid compounds, is preferably 10% by mol or less, more preferably 5% by mol or less, of the raw material monomers or monomer units for the polyester, from the viewpoint of reducing the low-molecular components.

Incidentally, the alcohol component and the carboxylic acid component may appropriately contain a monohydric alcohol and a monocarboxylic acid, respectively, from the viewpoint of molecular weight adjustment.

The polyester can be prepared by, for instance, polycondensation of the alcohol component with the carboxylic acid component at a temperature of 180° to 250° C. in an inert gas atmosphere under reduced pressure in the presence of an esterification catalyst as desired.

The polyester has a softening point of preferably from 80° to 165° C. and a glass transition temperature of preferably from 50° to 85° C. Also, the polyester has an acid value of preferably from 0.5 to 60 mg KOH/g and a hydroxyl value of preferably from 1 to 60 mg KOH/g, from the viewpoints of the dispersibility of the colorant and the transferability.

The toner of the present invention contains as charge control agents a negatively chargeable charge control agent and a positively chargeable charge control agent. Since these two charge control agents are used in combination, the environmental stability tends to be improved. Although not wanting to be limited by theory, this is presumably attributed to the evenness of the distribution of the charge control agents in the toner. The negatively chargeable charge control agent includes metal-containing azo dyes, for instance, "VARIFAST BLACK 3804," "BONTRON S-31" (hereinabove commercially available from Orient Chemical Co., Ltd.), "T-77" (commercially available from Hodogaya Chemical Co., Ltd.), "BONTRON S-32," "BONTRON S-34,""BONTRON S-36" (hereinabove commercially available from Orient Chemical Co., Ltd.), "AIZEN SPILON BLACK TRH" (commercially available from Hodogaya Chemical Co., Ltd.); copper phthalocyanine dyes; metal complexes of alkyl derivatives of salicylic acid, for instance, "BONTRON E-81," "BONTRON E-82," "BONTRON E-84," "BONTRON E-85" (hereinabove commercially available from Orient Chemical Co., Ltd.); nitroimidazole derivatives; boron complexes of benzilic acid, for instance, "LR-147" (commercially available from Japan Carlit); and the like. Among them, metal-containing azo dyes and metal complexes of alkyl derivatives of salicylic acid are preferable, more preferably metal-containing azo dyes, from the viewpoints of the triboelectric stability and the environmental stability.

The negatively chargeable charge control agent is contained in an amount of preferably from 0.5 to 5 parts by weight, more preferably from 1 to 3 parts by weight, based on 100 parts by weight of the resin binder.

The positively chargeable charge control agent includes Nigrosine dyes, for instance, "Nigrosine Base EX," "Oil Black BS," "Oil Black SO," "BONTRON N-01," "BONTRON N-07," "BONTRON N-09," "BONTRON N-11" (hereinabove commercially available from Orient Chemical Co., Ltd.); triphenylmethane-based dyes containing a tertiary amine as a side chain, quaternary ammonium salt compounds, for instance, "BONTRON P-51," "BONTRON P-52" (hereinabove commercially available from Orient Chemical Co., Ltd.), "TP-415" (commercially available from Hodogaya Chemical Co., Ltd.), cetyltrimethylammonium bromide, "COPY CHARGE PX VP435" (commercially available from Hoechst), and the like; polyamine resins, instance, "AFP-B" (commercially available from Orient Chemical Co., Ltd.), and the like; and imidazole derivatives, for instance, "PLZ-2001," "PLZ-8001" (hereinabove commercially available from Shikoku Kasei K.K.), and the like. Among them, Nigrosine dyes and triphenylmethane-based dyes are preferable, more preferably Nigrosine dyes, from the viewpoints of the dispersibility and the triboelectric stability of the toner.

The positively chargeable charge control agent is contained in an amount of preferably from 0.05 to 5 parts by weight, more preferably from 0.05 to 1 part by weight, based on 100 parts by weight of the resin binder.

The weight ratio of the negatively chargeable charge control agent to the positively chargeable charge control agent (negatively chargeable charge control agent/positively chargeable charge control agent) is not particularly limited, and the weight ratio is preferably from 60/1 to 3/1. The preferable ranges of the weight ratio of the negatively chargeable charge control agent to the positively chargeable charge control agent vary according to the combination. When the metal-containing azo dye is contained as the negatively chargeable charge control agent and a Nigrosine dye is contained as the positively chargeable charge control agent, the weight ratio of the metal-containing azo dye to the Nigrosine dye is preferably from 30/1 to 3/1, more preferably from 20/1 to 5/1.

As the colorants in the present invention, all of the dyes, pigments and the like which are used as colorants for toners can be used. The colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. The toner of the present invention may be any of black toners, mono-color toners and full-color toners. The amount of the colorant used is preferably from 1 to 40 parts by weight, more preferably from 3 to 10 parts by weight, based on 100 parts by weight of the resin binder.

The toner of the present invention may contain a magnetic powder from the viewpoint of preventing toner scattering. The magnetic powder includes alloys such as magnetite, hematite and ferrite; ferromagnetic metal powders of iron, cobalt and nickel; and the like. It is preferable that the magnetic powder is contained in an amount of from 0.5 to 10 parts by weight based on 100 parts by weight of the resin binder.

In the toner of the present invention, additives such as releasing agents, fluidity improvers, electric conductivity modifiers, extenders, reinforcing fillers such as fibrous substances, antioxidants, anti-aging agents, and cleanability improvers may be appropriately added internally or externally. Especially, as the external additives, fine silica-based particles composed of silicon dioxide, aluminum silicate, sodium silicate, potassium silicate, zinc silicate or magnesium silicate, is preferable.

The process for preparing the toner of the present invention may be any of conventionally known methods such as a kneading-pulverization method, an emulsion phase-inversion method and polymerization method, and the kneading and pulverization method is preferable because the preparation of the toner is easy. For instance, in a case of a pulverized toner prepared by the kneading and pulverization method, the toner can be prepared by homogeneously mixing a resin binder, a charge control agent, a colorant, and the like in a mixer such as a Henschel mixer, thereafter melt-kneading with a closed kneader, a single-screw or twin-screw extruder or the like, cooling, pulverizing and classifying the product. The volume-average particle size of the toner is preferably from 3 to 15 μm.

The toner of the present invention can be used alone as a developer, in a case where the fine magnetic material powder is contained. Alternatively, the toner can be used as a nonmagnetic one-component developer, or the toner can be mixed with a carrier as a two-component developer, in a case where the fine magnetic material powder is not contained.

In the preferred toner of the present invention, an external additive such as silica is less likely to be embedded in the toner surface, and stable triboelectric charges can be maintained even under high-temperature, high-humidity environmental conditions. Therefore, the toner of the present invention may be suitably used as a toner for non-contact type development.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which a half of the resin flows out, when measured by using a flow tester of the "koka" type "CFT-500D" (commercially available from Shimadzu Corporation) (sample: 1 g, rate of raising temperature: 6° C./min, load: 1.96 MPa, and nozzle: 1 mmϕ×1 mm).

[Glass Transition Temperature of Resin]

The glass transition temperature of a resin is determined using a differential scanning calorimeter "DSC 210" (commercially available from Seiko Instruments, Inc.) while raising the temperature of 15 mg of a sample at a rate of 10° C./min.

[Acid Value and Hydroxyl Value of Resin]

The acid value and the hydroxyl value of a resin are measured by a method according to JIS K 0070.

[Content of Fumaric Acid, Maleic Acid or Both]

1. Preparation of Sample Solution (1) The amount 0.2 g of a sample (toner) is weighed, and toluene is added to make up a volume of 20 ml.

(2) Two milliliters of the solution prepared is transferred to a test tube with a cap, and 5 ml of ion-exchanged water is then added.

(3) The mixed solution in the test tube is sufficiently stirred using a Test tube mixer and allowed for phase separation using a centrifuge, and the lower layer (aqueous phase) is collected as the sample solution.

2. Preparation of Calibration Curves

About 0.1 g of each of fumaric acid and maleic acid is weighed, and ion-exchanged water is added to precisely make up a volume of 100 ml. Calibration curves were obtained using 1 to 15 mg/l calibration solutions.

3. Preparation of Eluant

A solution prepared by dissolving 1 ml of a 0.1% aqueous phosphoric acid solution in 1 liter of ion-exchanged water was used as an eluant.

4. High Performance Liquid Chromatographic Determination

| | |
|---|---|
| Apparatus: | commercially available from Tosoh Corporation, 8020 Series |
| Autosampler: | Injected amount: 20 μl, Time for analysis: 10 min |
| Pump: | Flow rate: 1.0 ml/min |
| Column Oven: | 40° C. |
| Column: | Chemicals Evaluation and Research Institute, Japan L-column ODS (4.0 ϕ × 10 + 4.6 ϕ × 150 mm) |
| Detector: | UVD 210 nm |

5. Calculation for Contents of Fumaric Acid and Maleic Acid

The amount of fumaric acid and maleic acid remaining in the toner is determined as weight percentage (% by weight) by comparing the chart for the sample measured with the calibration curve, and determining the ratio of the areas.

Resin Preparation Example 1

The amount 1050 g of polyoxypropylene(2.2)-2,2-bis(4-hydroxyphenyl)propane, 355 g of fumaric acid, 1 g of hydroquinone (polymerization inhibitor) and 1.4 g of dibutyltin oxide (esterification catalyst) were reacted at 210° C. for 5 hours at atmospheric pressure under a nitrogen gas atmosphere. Thereafter, the ingredients were reacted at 210° C. for 7 hours under reduced pressure, to give a resin A. The resulting resin had a softening point of 102.0° C., an acid value of 19.8 mg KOH/g, and a glass transition temperature of 58.0° C.

Resin Preparation Example 2

The amount 1050 g of polyoxypropylene(2.2)-2,2-bis(4-hydroxyphenyl)propane, 355 g of fumaric acid, 1 g of hydroquinone (polymerization inhibitor) and 1.4 g of dibutyltin oxide (esterification catalyst) were reacted at 210° C. for 6 hours at atmospheric pressure under a nitrogen gas atmosphere. Thereafter, the ingredients were reacted at 210° C. for 10 hours under reduced pressure, to give a resin B. The resulting resin had a softening point of 109.1° C., an acid value of 8.7 mg KOH/g, and a glass transition temperature of 60.6° C.

Resin Preparation Example 3

The amount 1040 g of polyoxypropylene(2.2)-2,2-bis(4-hydroxyphenyl)propane, 10 g of polyoxyethylene(2.0)-2,2-bis(4-hydroxyphenyl)propane, 199 g of terephthalic acid and 4 g of dibutyltin oxide (esterification catalyst) were reacted at 230° C. for 5 hours at atmospheric pressure under a nitrogen gas atmosphere, and further reacted under reduced pressure. Thereafter, the reaction mixture was cooled to 210° C., and 209 g of fumaric acid and 1 g of hydroquinone were added. The ingredients were reacted for 5 hours, and further reacted for 6 hours under reduced pressure, to give a resin C. The resulting resin had a softening point of 109.5° C., an acid value of 21.3 mg KOH/g, and a glass transition temperature of 64.4° C.

Resin Preparation Example 4

The amount 1050 g of polyoxypropylene(2.2)-2,2-bis(4-hydroxyphenyl)propane, 355 g of fumaric acid, 1 g of hydroquinone (polymerization inhibitor) and 1.4 g of dibutyltin oxide (esterification catalyst) were reacted at 210° C. for 4.5 hours at atmospheric pressure under a nitrogen gas atmosphere. Thereafter, the ingredients were reacted at 210° C. for 2 hours under reduced pressure, to give a resin D. The resulting resin had a softening point of 97.2° C., an acid value of 24.6 mg KOH/g, and a glass transition temperature of 55.4° C.

Resin Preparation Example 5

The amount 830 g of polyoxypropylene(2.2)-2,2-bis(4-hydroxyphenyl)propane, 320 g of polyoxyethylene(2.0)-2,2-bis(4-hydroxyphenyl)propane, 233 g of terephthalic acid, 245 g of dodecenylsuccinic anhydride, 140 g of trimellitic anhydride and 4 g of dibutyltin oxide (esterification catalyst) were reacted at 230° C. for 8 hours at atmospheric pressure under a nitrogen gas atmosphere, and further reacted for 5 hours under reduced pressure, to give a resin E. The resulting resin had a softening point of 138.5° C., an acid value of 25.8 mg KOH/g, and a glass transition temperature of 65.8° C.

Examples 1 to 5 and Comparative Examples 1 and 2

One-hundred parts by weight of a resin binder as shown in Table 1, a negatively chargeable charge control agent "BONTRON S-34" (commercially available from Orient Chemical Co., Ltd.) and a positively chargeable charge control agent "BONTRON N-07" (commercially available from Orient Chemical Co., Ltd.) as shown in Table 1, 6 parts by weight of a carbon black "Mogul L" (commercially available from Cabot Corporation), 2 parts by weight of a polypropylene wax "Hiwax NP-105" (commercially available from MITSUI CHEMICALS, INC.) and 1 part by weight of a magnetite "EPT 1002" (commercially available from Toda Kogyo Corp.) were melt-kneaded using a twin-screw kneader "PCM-45" (commercially available from IKEGAI Corporation) with a feed amount of 40 kg/min at a rotational speed of 200 rpm at a kneading temperature of 100° C. The resulting product was finely pulverized with a jet mill and classified by air classification, to give a powder having a volume-average particle size of 8.5 μm.

To 100 parts by weight of the resulting powder were adhered 0.9 parts by weight of a hydrophobic silica "Aerosil R-972" (commercially available from Nippon Aerosil) by mixing them with a Henschel mixer, to give a negatively chargeable toner.

Test Example

The amount 0.6 g of a toner and 9.4 g of a carrier were placed in a 20-ml plastic container, and agitated for 5 minutes with a turbuler mixer, to give two two-component developers.

The triboelectric charges (μC/g) of each two-component developer prepared were measured by the following method using a Q/M meter (commercially available from Epping GmbH). Thereafter one of the two-component developers was allowed to stand for 2 hours under a normal-termperature, normal-humidity (NN) environment at a temperature of 25° C. and a relative humidity of 55%, while the other was allowed to stand for 2 hours under a high-temperature, high-humidity (HH) environment at a temperature of 40° C. and a relative humidity of 90%.

[Method for Measuring Triboelectric Charges]

A specified amount of a developer is supplied in a cell provided in the Q/M meter, and only toner is aspirated for 90 seconds through a sieve having a sieve opening of 32 μm (made of stainless steel, wire diameter: 0.035 mm). The voltage change generated on the carrier at this time is monitored, and the value of [Total Electric Charges (μC) After 90 Seconds/Weight (g) of Toner Aspirated] is calculated as the triboelectric charges (μC/g).

After being allowed to stand, each two-component developer was again agitated for 5 minutes with a turbuler mixer, the triboelectric charges (μC/g) were measured, the HH/NN remaining ratio of triboelectric charges was determined using the following equation, and the triboelectric stability was evaluated according to the evaluation criteria. The results are shown in Table 1. Incidentally, the changes (after being allowed to stand/before being allowed to stand) in triboelectric charges under the NN environment was within the range between 0.8 and 0.95.

$$HH/NN \text{ Remaining Ratio of Triboelectric Charges } (\%) = \frac{\dfrac{\text{Triboelectric Charges After } HH}{\text{Triboelectric Charges Before } HH}}{\dfrac{\text{Triboelectric Charges After } NN}{\text{Triboelectric Charges Before } NN}} \times 100$$

wherein "Triboelectric Charges After/Before HH" means triboelectric charges after/before being allowed to stand under HH environment; and "Triboelectric Charges After/Before NN" means triboelectric charges after/before being allowed to stand under NN environment.

[Evaluation Criteria]

The HH/NN remaining ratio of triboelectric charges is:

⊙⊙: 70% or more;

⊙: 50% or more and less than 70%;

○: 40% or more and less than 50%; and

×: less than 40%.

TABLE 1

| | Resin Binder | Charge Control Agent: Negatively Chargeable | Charge Control Agent: Positively Chargeable | Content of Fumaric Acid, Maleic Acid or Both (% by weight) | Triboelectric Stability |
|---|---|---|---|---|---|
| Ex. 1 | Resin A/82<br>Resin E/18 | 1.0 | 0.15 | 0.13 | ⊙ |
| Ex. 2 | Resin B/100 | 1.0 | 0.15 | 0.02 | ⊙⊙ |
| Ex. 3 | Resin C/100 | 1.0 | 0.15 | 0.13 | ⊙ |
| Ex. 4 | Resin C/100 | 1.0 | 0.05 | 0.13 | ⊙ |
| Ex. 5 | Resin C/100 | 0.5 | 0.15 | 0.13 | ○ |
| Comp. Ex. 1 | Resin D/100 | 1.0 | 0.15 | 0.22 | X |
| Comp. Ex. 2 | Resin C/100 | 1.0 | — | 0.13 | X |

Note)
The amounts of the resin binders and the charge control agents used are expressed in parts by weight.

It can be seen from the above results that, in the toners of Examples, which contain a negatively chargeable charge control agent and a positively chargeable charge control agent, wherein fumaric acid, maleic acid or both fumaric acid and maleic acid is contained in a specified amount or less, changes in the triboelectric charges due to environmental changes, such as temperature and humidity, are small, and the toners have excellent triboelectric stability, as compared to the toners of Comparative Examples.

The toner for electrostatic image development of the present invention may be used for the development of a latent image formed in electrophotography, electrostatic recording method, electrostatic printing method or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development, comprising:

a resin binder comprising a polyester having monomer units wherein at least one monomer is selected from the group consisting of fumaric acid, maleic acid, and mixtures thereof;

a colorant; and a charge control agent comprising a negatively chargeable charge control agent and a positively chargeable charge control agent, wherein unreacted monomers of fumaric acid, maleic acid or both fumaric acid and maleic acid are contained in the toner in an amount of 0.20% by weight or less.

2. The toner according to claim 1, wherein the negatively chargeable charge control agent is a metal-containing azo dye and the positively chargeable charge control agent is a Nigrosine dye, wherein the weight ratio of the metal-containing azo dye to the Nigrosine dye is from 30/1 to 3/1.

3. The toner according to claim 2, wherein the polyester comprises 10% by mol or less of trivalent or higher polyvalent monomers, based on the total monomer units of the polyester.

4. The toner according to claim 1, wherein the monomer units for the polyester further comprise an alcohol component and a carboxylic acid component, and fumaric acid, maleic acid or both fumaric acid and maleic acid are contained in an amount of from 40 to 100% by mol of the carboxylic acid component.

5. The toner according to claim 4, wherein the polyester comprises 10% by mol or less of trivalent or higher polyvalent monomers, based on the total monomer units of the polyester.

6. The toner according to claim 1, wherein the polyester comprises 10% by mol or less of trivalent or higher polyvalent monomers, based on the total monomer units of the polyester.

7. The toner according to claim 1, wherein the polyester comprises polymerized units of fumaric acid and maleic acid.

8. The toner according to claim 1, wherein unreacted monomers of fumaric acid, maleic acid or both fumaric acid and maleic acid are present in an amount of 0.01 to 0.15% by weight.

9. The toner according to claim 1, wherein unreacted monomers of fumaric acid, maleic acid or both fumaric acid and maleic acid are present in an amount of from 0.01 to 0.1% by weight.

10. The toner according to claim 1, wherein the polyester is present in an amount of 100% by weight of the resin binder.

11. The toner according to claim 1, wherein the resin binder further comprises at least one selected from the group consisting of a styrene-acrylic resin, an epoxy resin, a polycarbonate, and a polyurethane resin.

12. The toner according to claim 1, wherein the polyester further comprises reacted units of at least one dicarboxylic acid selected from the group consisting of phthalic acid, isophthalic acid, terephthalic acid, an anhydride of phthalic acid, an anhydride of isophthalic acid, an anhydride of terephthalic acid, an alkyl 1–12 carbon atom ester of phthalic acid, an alkyl 1–12 carbon atom ester of isophthalic acid and an alkyl 1–12 carbon atom ester of terephthalic acid.

13. The toner according to claim 1, wherein the polyester has a softening point of from 50 to 85° C.

14. The toner according to claim 1, wherein the polyester comprises reacted units of fumaric acid and polyoxypropylene(2.2)-2,2-bis(4-hydroxyphenyl) propane.

15. The toner according to claim 1, wherein the polyester comprises reacted units of fumaric acid.

* * * * *